US009004728B2

(12) United States Patent
Thompson

(10) Patent No.: US 9,004,728 B2
(45) Date of Patent: Apr. 14, 2015

(54) LIGHT ASSEMBLY

(71) Applicant: ABL IP Holding LLC, Conyers, GA (US)

(72) Inventor: Paul Gregory Thompson, Loganville, GA (US)

(73) Assignee: ABL IP Holding LLC, Conyers, GA (US)

( * ) Notice: Subject to any disclaimer, the term of this patent is extended or adjusted under 35 U.S.C. 154(b) by 0 days.

(21) Appl. No.: 13/833,597

(22) Filed: Mar. 15, 2013

(65) Prior Publication Data

US 2014/0268836 A1 Sep. 18, 2014

(51) Int. Cl.

| | |
|---|---|
| ***F21V 21/00*** | (2006.01) |
| ***F21S 8/02*** | (2006.01) |
| ***F21V 21/14*** | (2006.01) |
| ***F21V 21/30*** | (2006.01) |
| *F21V 21/04* | (2006.01) |
| *F21V 21/03* | (2006.01) |
| *F21V 21/10* | (2006.01) |
| *F21V 21/108* | (2006.01) |

(52) U.S. Cl.

CPC *F21S 8/026* (2013.01); *F21S 8/028* (2013.01); *F21S 8/02* (2013.01); *F21V 21/04* (2013.01); *F21V 21/03* (2013.01); *F21V 21/10* (2013.01); *F21V 21/108* (2013.01); *F21V 21/14* (2013.01); *F21V 21/30* (2013.01)

(58) Field of Classification Search

CPC ..... F21S 8/02; F21S 8/026; F21S 8/028; F21V 1/03; F21V 1/10; F21V 1/108

USPC ..... 362/145, 147, 149, 150, 249.02, 235, 362/231, 232, 247.03, 249.11, 362–375, 362/418–419, 422–430

See application file for complete search history.

(56) References Cited

U.S. PATENT DOCUMENTS

| | | | | |
|---|---|---|---|---|
| 3,609,346 | A | | 9/1971 | Lund et al. |
| 3,660,651 | A | * | 5/1972 | Miles, Jr. ..... 362/366 |
| 3,974,371 | A | | 8/1976 | Miles, Jr. |
| 4,462,068 | A | | 7/1984 | Shadwick |
| 5,207,781 | A | | 5/1993 | Röck |
| 5,291,381 | A | | 3/1994 | Price |
| 5,562,343 | A | | 10/1996 | Chan et al. |
| 5,823,664 | A | | 10/1998 | Demshki, Jr. et al. |
| 6,082,878 | A | | 7/2000 | Doubek et al. |
| 6,120,164 | A | | 9/2000 | Libin et al. |

(Continued)

FOREIGN PATENT DOCUMENTS

| | | |
|---|---|---|
| CA | 2609531 | 11/2006 |

OTHER PUBLICATIONS

Office Action for Canadian Application No. 2,861,719, mailed Oct. 7, 2014.

(Continued)

*Primary Examiner* — Jong-Suk (James) Lee
*Assistant Examiner* — Zheng Song
(74) *Attorney, Agent, or Firm* — Kilpatrick Townsend & Stockton, LLP

(57) ABSTRACT

A light assembly that includes a mounting frame on which a light engine is mounted so as to direct light through the mounting frame opening and out of an opening in the ceiling. The light assembly is designed to permit the light engine to be rotated and tilted, in some embodiments without the need for tools.

9 Claims, 18 Drawing Sheets

(56) References Cited

U.S. PATENT DOCUMENTS

| | | | | |
|---|---|---|---|---|
| 6,402,112 | B1 | 6/2002 | Thomas et al. | |
| 6,461,021 | B1 | 10/2002 | Warnecke | |
| 6,471,374 | B1 | 10/2002 | Thomas et al. | |
| 6,491,407 | B1 | 12/2002 | Beadle | |
| 6,634,764 | B2 | 10/2003 | Kotovsky et al. | |
| 6,652,124 | B2 | 11/2003 | Schubert et al. | |
| 6,719,438 | B2 | 4/2004 | Sevack et al. | |
| 6,860,624 | B2 | 3/2005 | Hille et al. | |
| 6,926,427 | B2 | 8/2005 | Tawil et al. | |
| 6,953,270 | B1 | 10/2005 | Richardson | |
| 7,182,496 | B2 | 2/2007 | Ruffin | |
| 7,213,940 | B1 | 5/2007 | Van De Ven et al. | |
| 7,316,359 | B2 | 1/2008 | Beidokhti | |
| 7,431,482 | B1 * | 10/2008 | Morgan et al. | 362/364 |
| 7,476,008 | B2 * | 1/2009 | Kay | 362/364 |
| 7,478,931 | B2 | 1/2009 | Miletich et al. | |
| 7,484,866 | B1 | 2/2009 | Buse | |
| 7,530,705 | B2 | 5/2009 | Czech et al. | |
| 7,559,677 | B1 | 7/2009 | Dupre | |
| 7,618,166 | B1 | 11/2009 | Truax et al. | |
| 7,631,987 | B2 | 12/2009 | Wei | |
| 7,637,636 | B2 | 12/2009 | Zheng et al. | |
| 7,670,028 | B2 | 3/2010 | Liu et al. | |
| 7,703,951 | B2 | 4/2010 | Piepgras et al. | |
| 7,722,227 | B2 | 5/2010 | Zhang et al. | |
| 7,748,868 | B2 | 7/2010 | Patti et al. | |
| 7,753,562 | B2 | 7/2010 | Livesay et al. | |
| 7,766,518 | B2 | 8/2010 | Piepgras et al. | |
| 7,828,464 | B2 | 11/2010 | Wang et al. | |
| 7,832,901 | B2 | 11/2010 | Ladewig | |
| 7,857,492 | B2 | 12/2010 | Dixon | |
| 7,883,237 | B2 | 2/2011 | Zhang et al. | |
| 7,891,624 | B2 * | 2/2011 | Dittmer et al. | 248/323 |
| 7,896,529 | B2 | 3/2011 | Wronski et al. | |
| 7,905,633 | B2 | 3/2011 | Horng et al. | |
| 7,918,587 | B2 | 4/2011 | Hsu et al. | |
| 7,950,834 | B2 | 5/2011 | Dupre | |
| 7,959,332 | B2 | 6/2011 | Tickner et al. | |
| 7,993,034 | B2 | 8/2011 | Wegner | |
| 7,997,763 | B2 | 8/2011 | Giardina et al. | |
| 8,002,425 | B2 | 8/2011 | Russo et al. | |
| 8,021,013 | B2 | 9/2011 | Russo et al. | |
| 8,029,173 | B2 | 10/2011 | Ko | |
| 8,057,082 | B2 | 11/2011 | Seabrook | |
| 8,066,404 | B2 | 11/2011 | Song et al. | |
| 8,066,413 | B2 | 11/2011 | Czech et al. | |
| 8,070,316 | B2 | 12/2011 | Urano et al. | |
| 8,079,740 | B2 | 12/2011 | Huang et al. | |
| 8,100,565 | B2 | 1/2012 | Patti et al. | |
| 8,123,382 | B2 | 2/2012 | Patrick et al. | |
| 8,128,263 | B2 | 3/2012 | Higuchi et al. | |
| 8,182,116 | B2 | 5/2012 | Zhang et al. | |
| 8,215,805 | B2 | 7/2012 | Cogliano et al. | |
| 8,226,278 | B2 | 7/2012 | Ward et al. | |
| 2003/0161153 | A1 * | 8/2003 | Patti | 362/289 |
| 2005/0168986 | A1 | 8/2005 | Wegner | |
| 2006/0250788 | A1 | 11/2006 | Hodge et al. | |
| 2008/0025031 | A1 * | 1/2008 | Wronski et al. | 362/365 |
| 2008/0112171 | A1 | 5/2008 | Patti et al. | |
| 2008/0175003 | A1 | 7/2008 | Tsou et al. | |
| 2008/0266883 | A1 * | 10/2008 | Chen | 362/365 |
| 2009/0046456 | A1 | 2/2009 | Urano et al. | |
| 2009/0086476 | A1 | 4/2009 | Tickner et al. | |
| 2009/0103308 | A1 | 4/2009 | Xu et al. | |
| 2009/0116254 | A1 * | 5/2009 | Dupre | 362/427 |
| 2009/0141494 | A1 | 6/2009 | Zhang et al. | |
| 2009/0196053 | A1 * | 8/2009 | Ziobro et al. | 362/365 |
| 2009/0268474 | A1 * | 10/2009 | Ward et al. | 362/364 |
| 2009/0279314 | A1 | 11/2009 | Wu et al. | |
| 2009/0296414 | A1 | 12/2009 | Moriyama et al. | |
| 2010/0002453 | A1 | 1/2010 | Wu et al. | |
| 2010/0014287 | A1 | 1/2010 | Chiang et al. | |
| 2010/0053950 | A1 | 3/2010 | Higuchi et al. | |
| 2010/0085766 | A1 * | 4/2010 | Czech et al. | 362/365 |
| 2010/0110660 | A1 | 5/2010 | Brukilacchio | |
| 2010/0110698 | A1 | 5/2010 | Harwood et al. | |
| 2010/0149822 | A1 * | 6/2010 | Cogliano et al. | 362/365 |
| 2010/0157602 | A1 | 6/2010 | Nichols | |
| 2010/0165643 | A1 | 7/2010 | Russo et al. | |
| 2010/0195327 | A1 | 8/2010 | Inoue et al. | |
| 2010/0246178 | A1 | 9/2010 | Giardina et al. | |
| 2011/0044038 | A1 | 2/2011 | Mo | |
| 2011/0051410 | A1 | 3/2011 | Liang | |
| 2011/0069501 | A1 | 3/2011 | Chou et al. | |
| 2011/0116276 | A1 * | 5/2011 | Okamura et al. | 362/404 |
| 2011/0134634 | A1 | 6/2011 | Gingrich, III et al. | |
| 2011/0141741 | A1 * | 6/2011 | Engstrom et al. | 362/257 |
| 2011/0164422 | A1 | 7/2011 | Chan | |
| 2011/0182067 | A1 | 7/2011 | Watanabe | |
| 2011/0211346 | A1 | 9/2011 | Ogawa et al. | |
| 2011/0249434 | A1 | 10/2011 | McQuistian et al. | |
| 2011/0317444 | A1 * | 12/2011 | Chen | 362/523 |
| 2012/0051069 | A1 | 3/2012 | Lim | |
| 2012/0069545 | A1 | 3/2012 | Choi et al. | |
| 2012/0320577 | A1 * | 12/2012 | Wang | 362/235 |
| 2013/0294077 | A1 | 11/2013 | Gabrius et al. | |
| 2014/0085912 | A1 * | 3/2014 | David et al. | 362/419 |

OTHER PUBLICATIONS

Non-Final Office Action for U.S. Appl. No. 13/828,543, mailed Aug. 18, 2014.

* cited by examiner

FIG. 3a
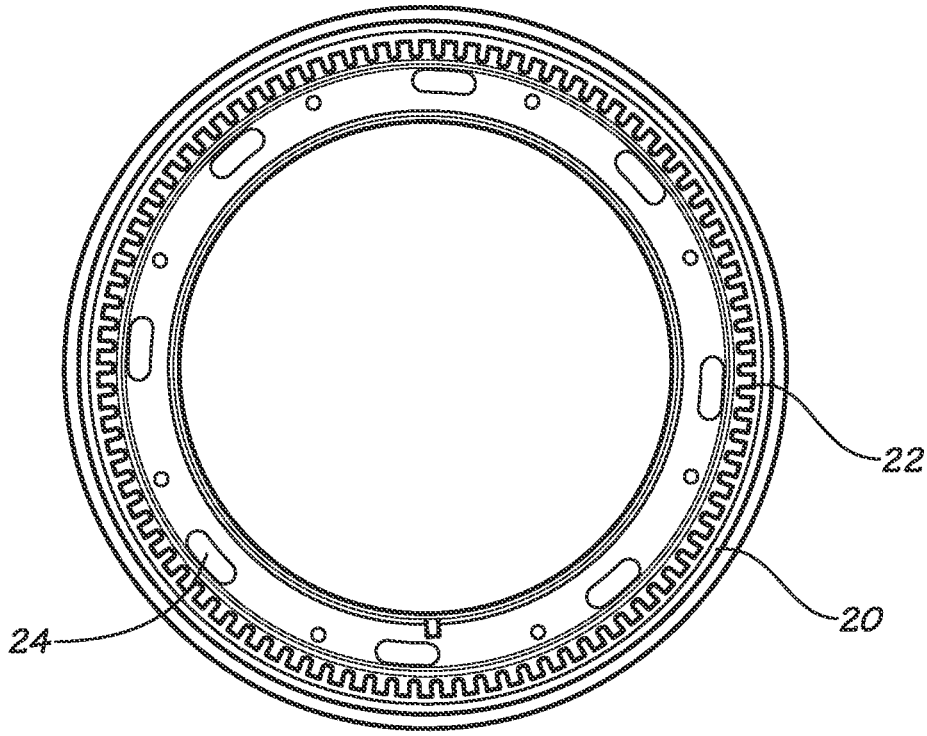
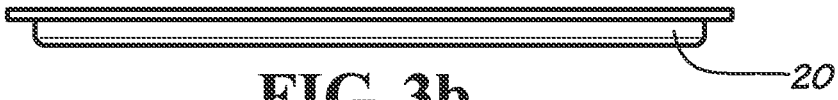
FIG. 3b
FIG. 3c
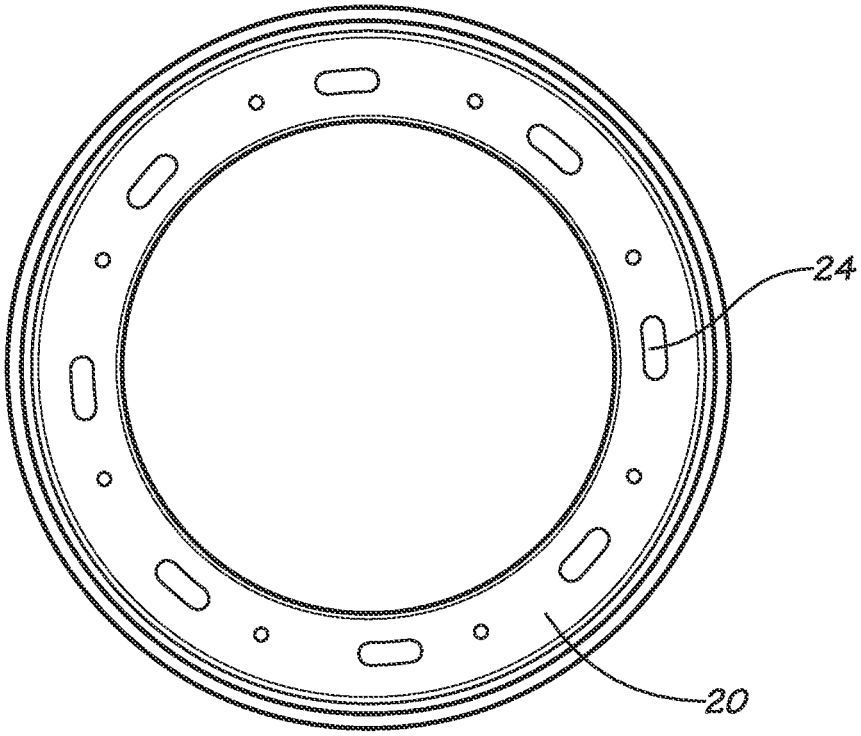

LIGHT ASSEMBLY

FIELD

Embodiments of the present invention relate to a light assembly for recessed positioning within a ceiling and having a light engine that can be rotated and tilted within the ceiling.

BACKGROUND

Light engines for recessed positioning within a ceiling opening are typically locked in position over the opening such that the fixture cannot be rotated or tilted to adjust the directionality and distribution of the light emitted from the light engine. To the extent that light engines are capable of being rotated and/or tilted once installed in a ceiling, such rotation or tilting can typically only be effectuated using tools.

SUMMARY

Certain embodiments of the present invention provide a light assembly that includes a mounting frame on which a light engine is mounted so as to direct light through the mounting frame opening and out of an opening in the ceiling. The light assembly is designed to permit the light engine to be rotated and tilted, in some embodiments without the need for tools.

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

BRIEF DESCRIPTION OF THE FIGURES

Illustrative embodiments of the present invention are described in detail below with reference to the following drawing figures:

FIGS. 3*a*-3*e* are various view of an embodiment of a mounting ring in isolation.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Figure 1:
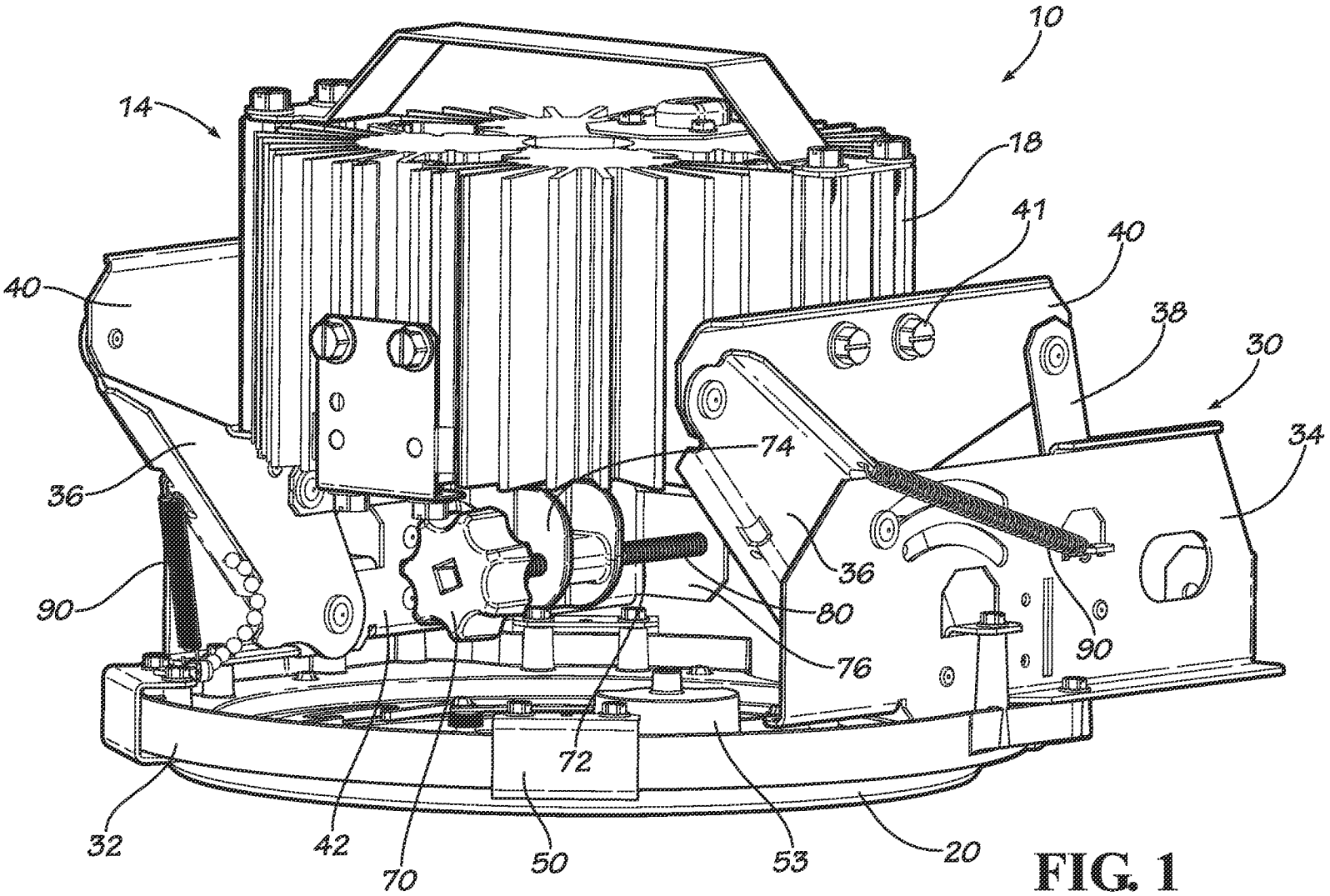
FIG. 1 is a perspective view of an embodiment of a light assembly.
Figure 2:
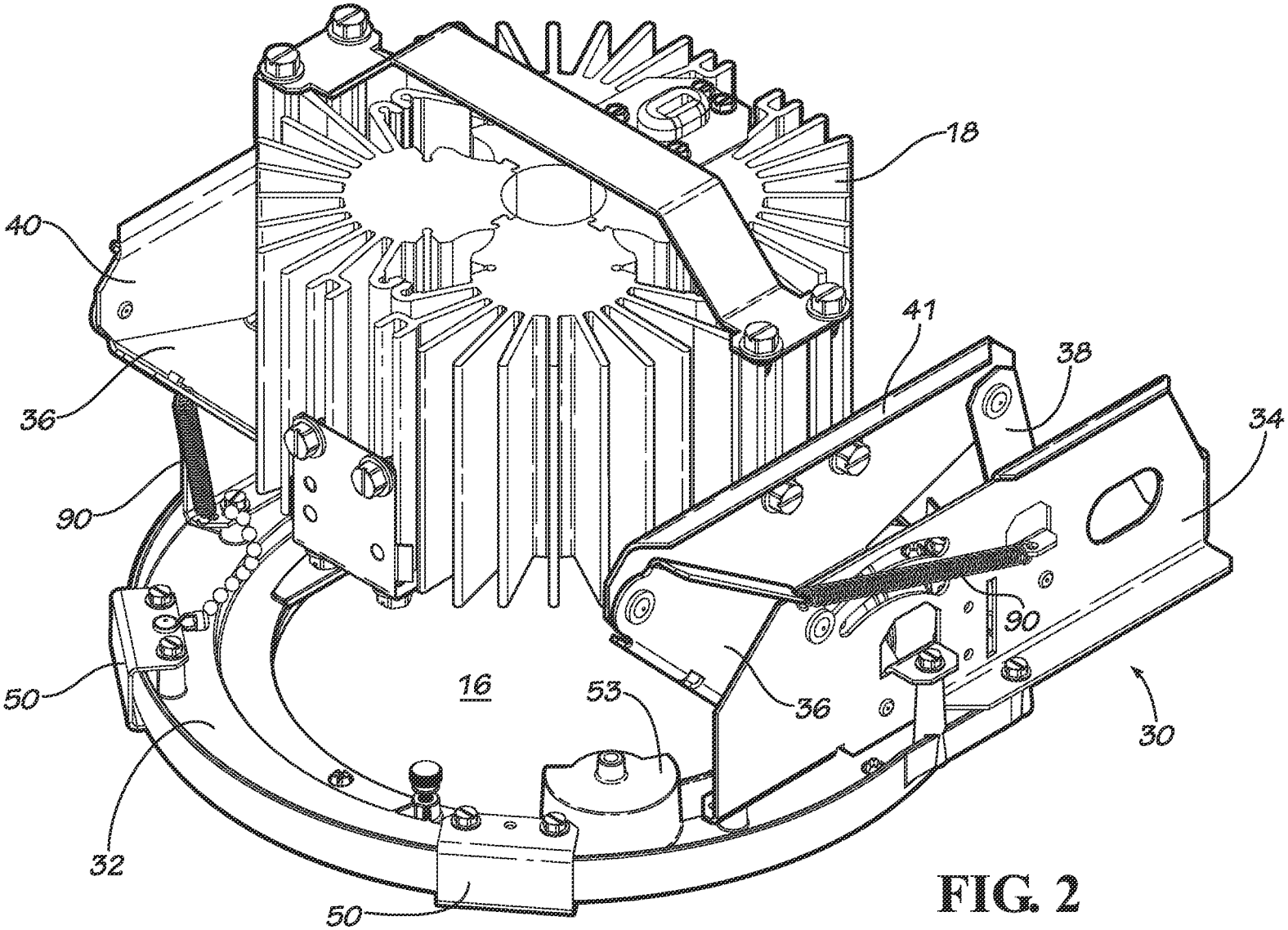
FIG. 2 is another perspective view of the light assembly of FIG. 1.
Figure 3D:
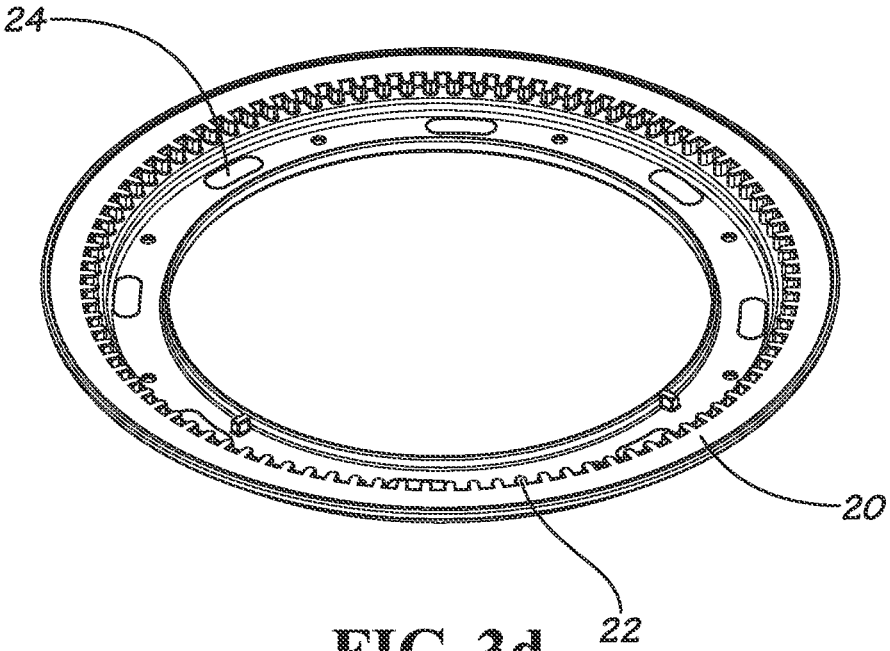
Figure 3E:
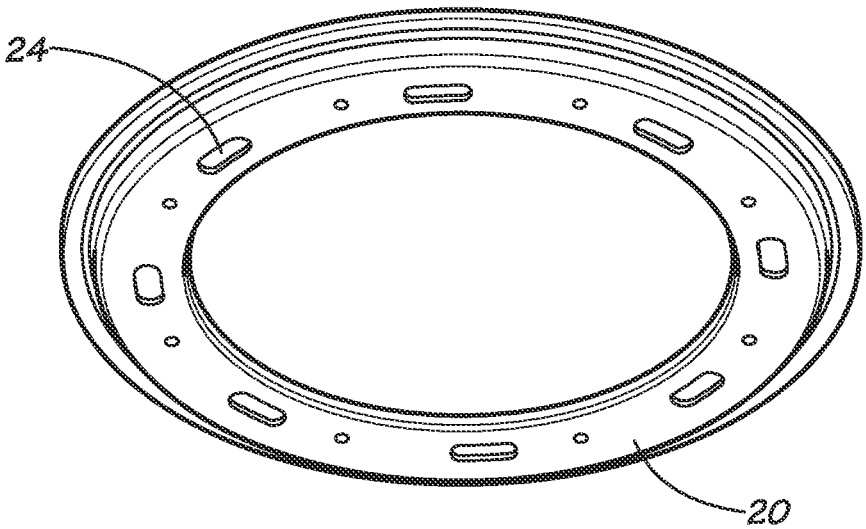
Figure 4:
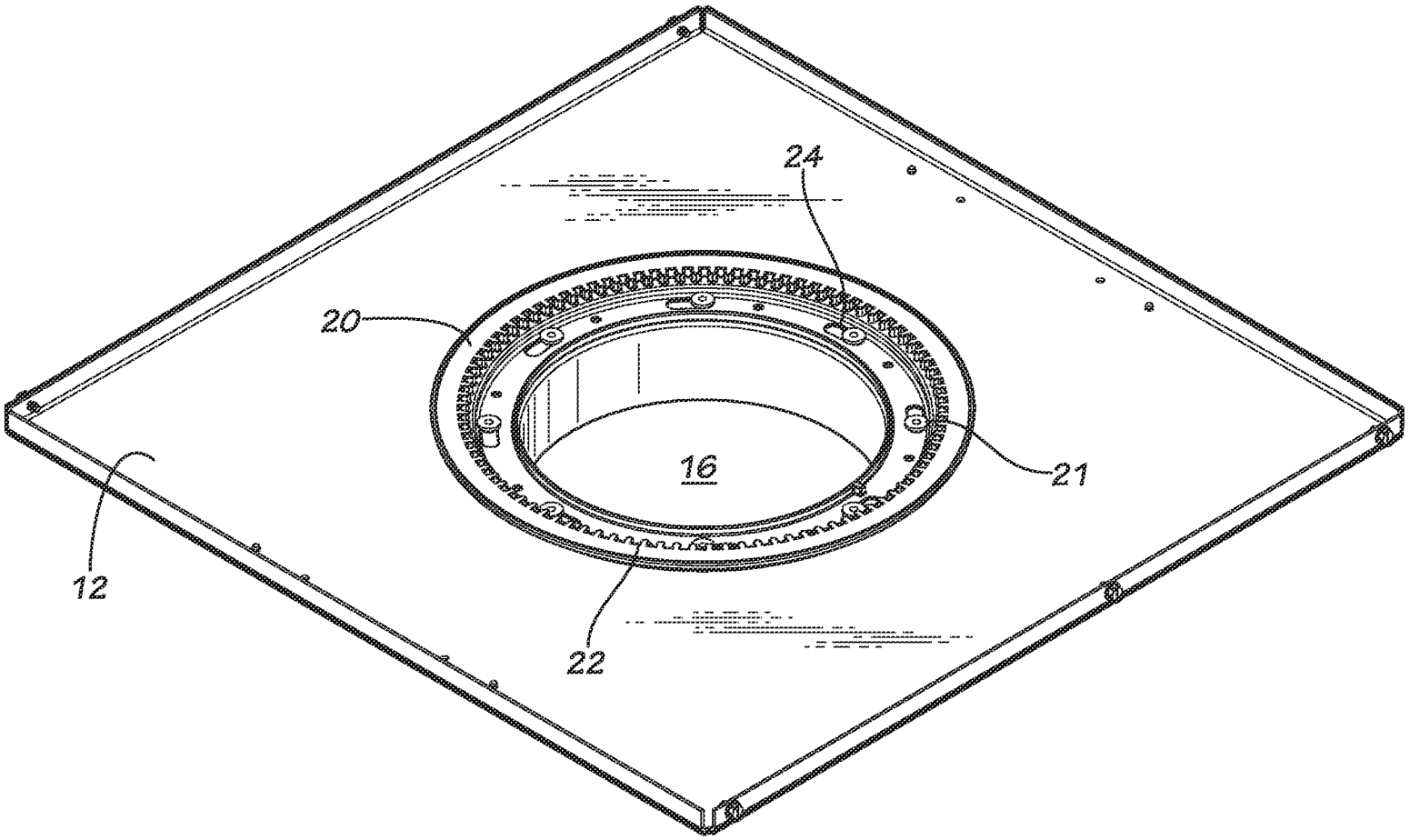
FIG. 4 is a top perspective view of the mounting ring of FIGS. 3*a*-3*e* mounted on a mounting frame.
Figure 5:
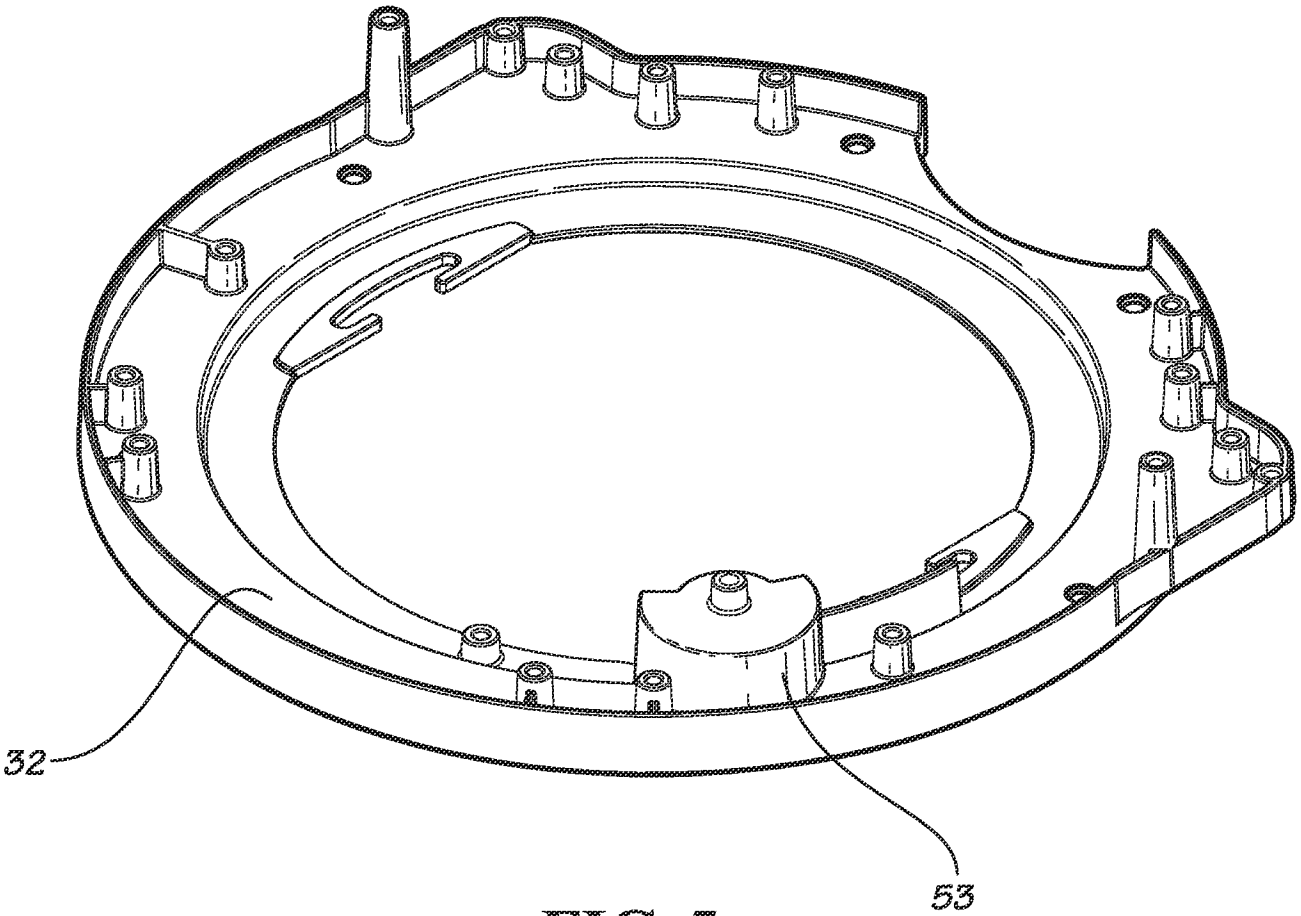
FIG. 5 is a top perspective view of an embodiment of a rotation ring.
Figure 6:
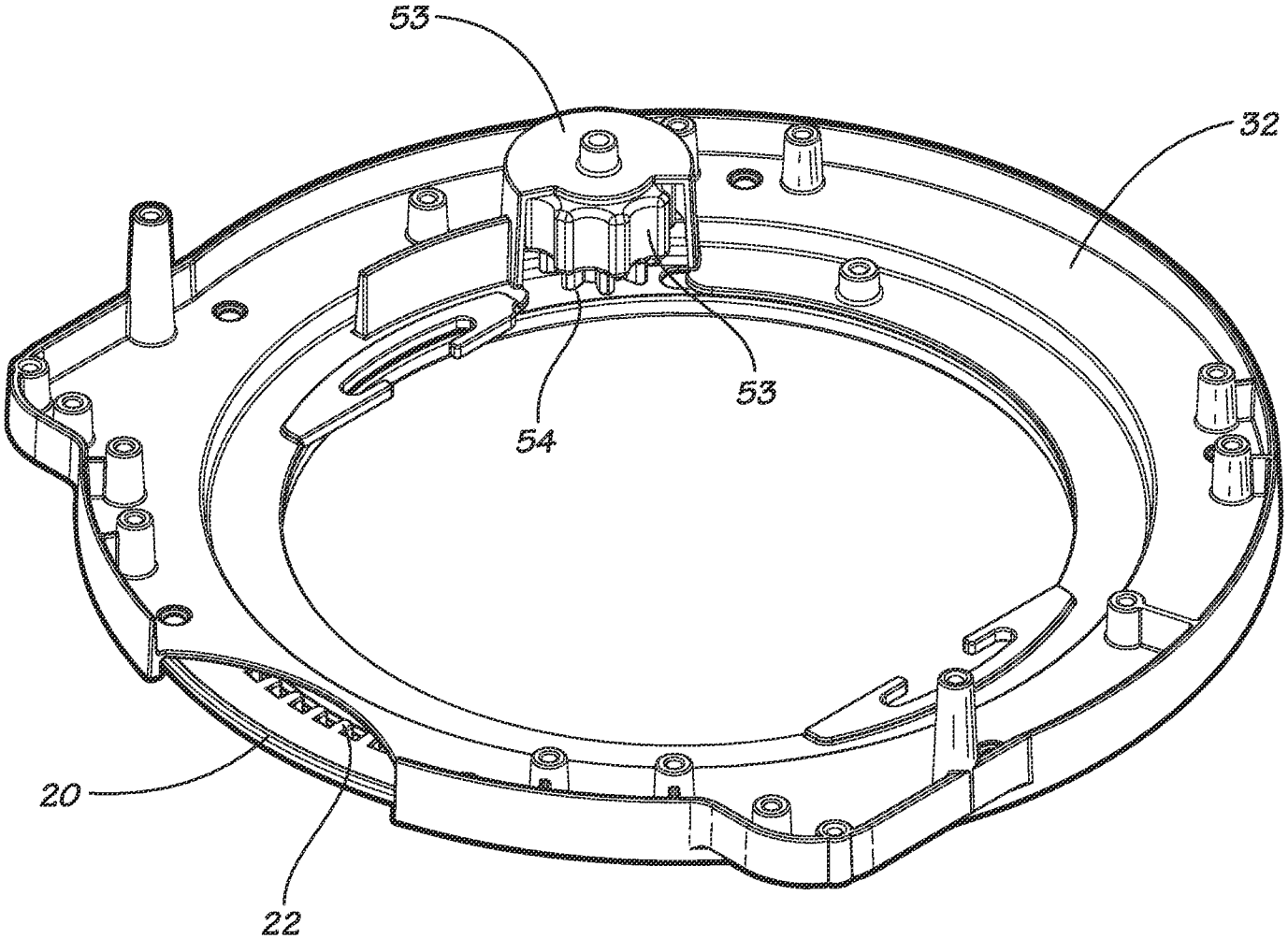
FIG. 6 is top perspective view of an embodiment of a rotation ring seated over an embodiment of a mounting ring.
Figure 7:
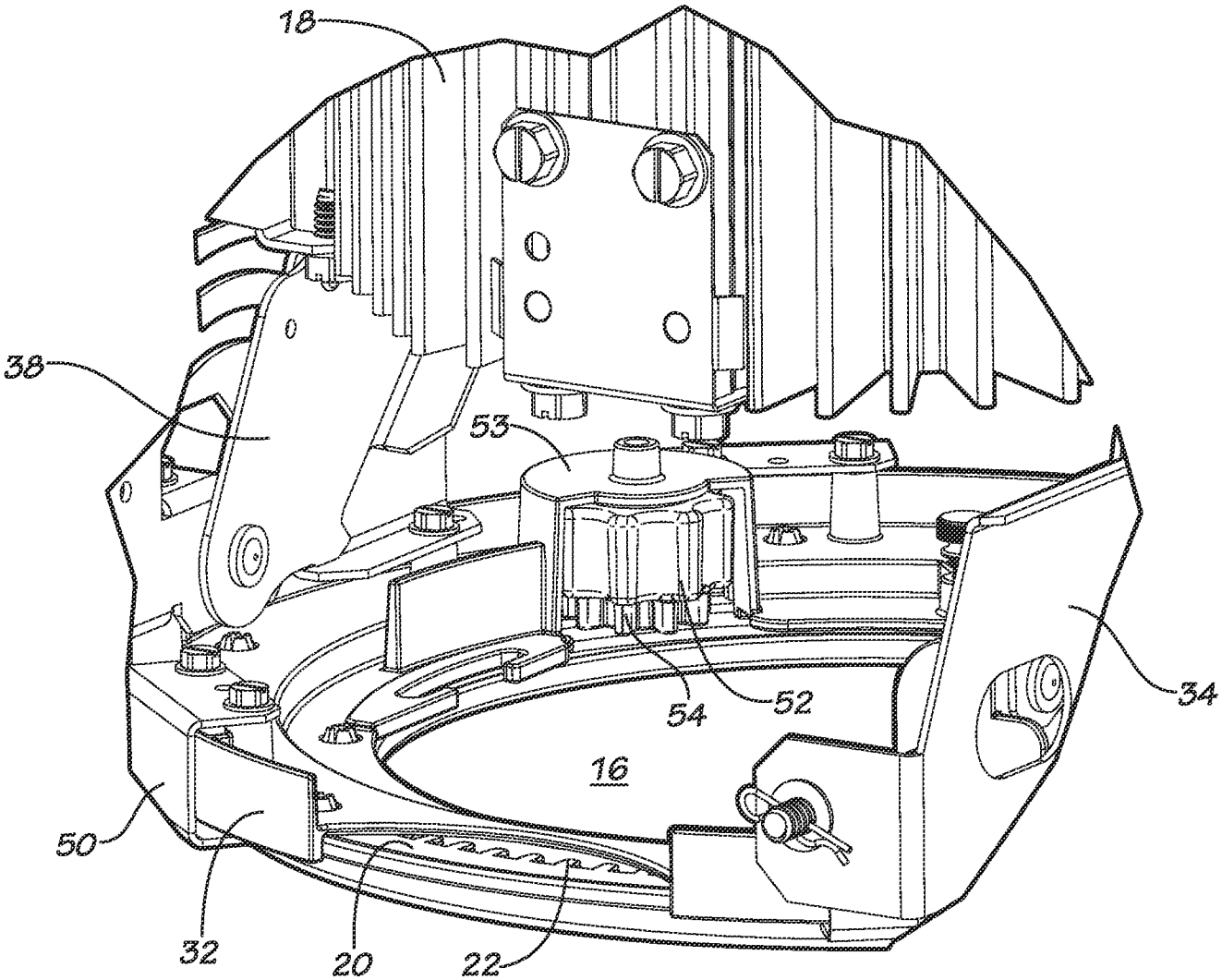
FIG. 7 is an enlarged partial view of a portion of the light assembly of FIG. 1.
Figure 8:
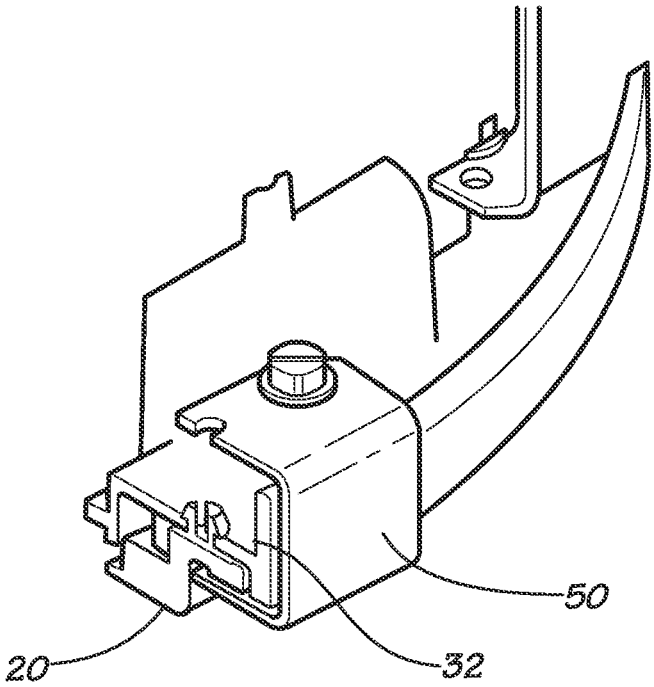
FIG. 8 is an enlarged partial view of an embodiment of a rotation ring secured to an embodiment of mounting ring.
Figure 9:
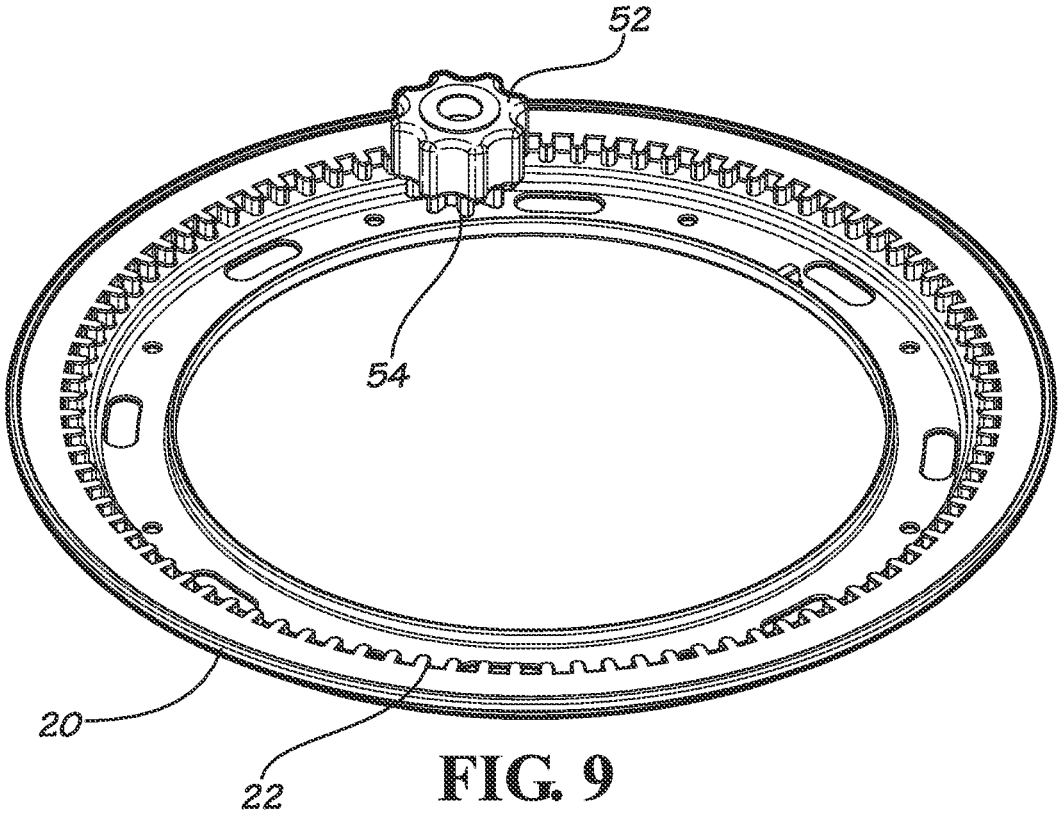
FIG. 9 is a top perspective view of a rotation knob engaging an embodiment of a mounting ring.
Figure 10:
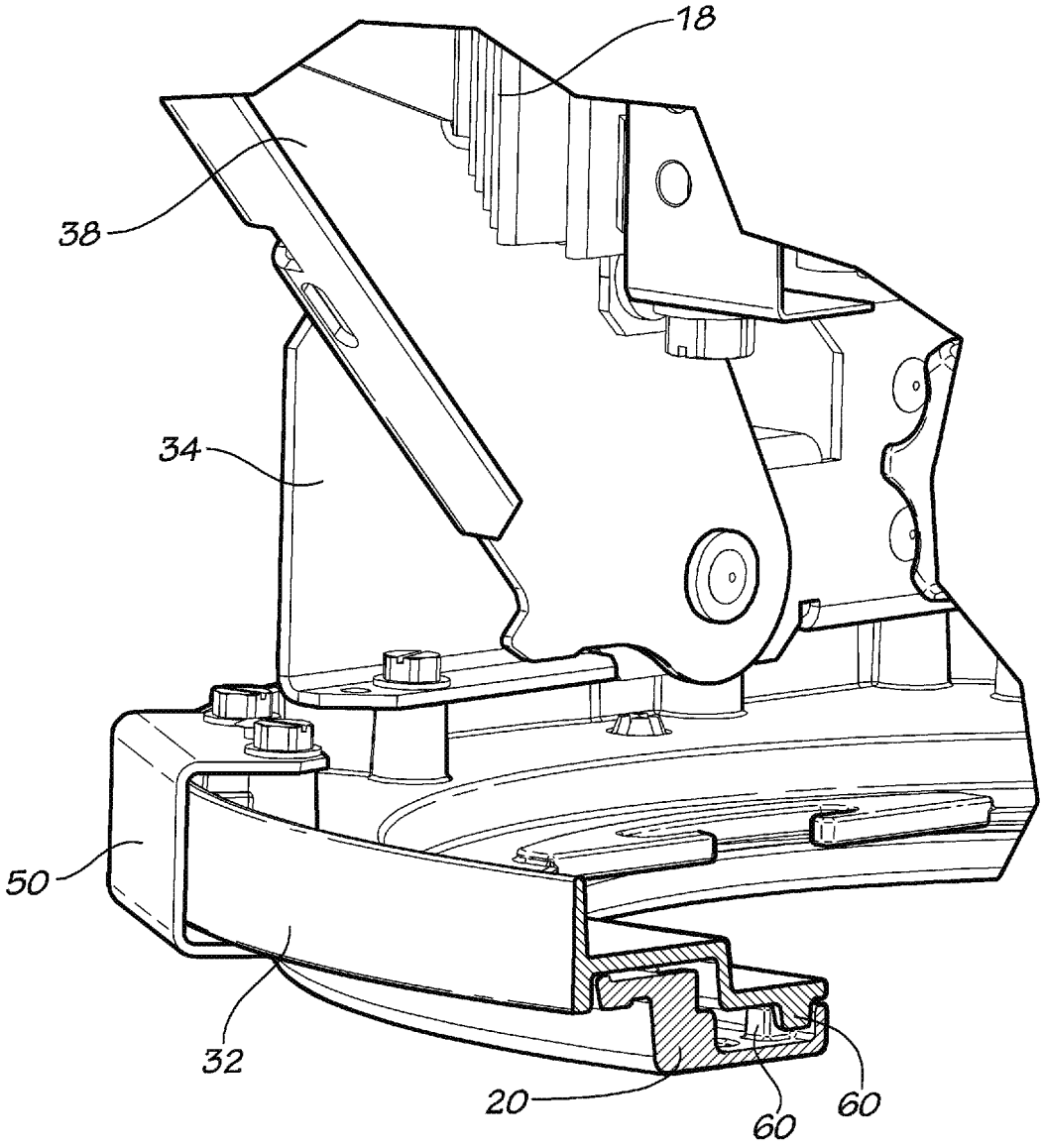
FIG. 10 is an enlarged partial view of a portion of the light assembly of FIG. 1.
Figure 11:
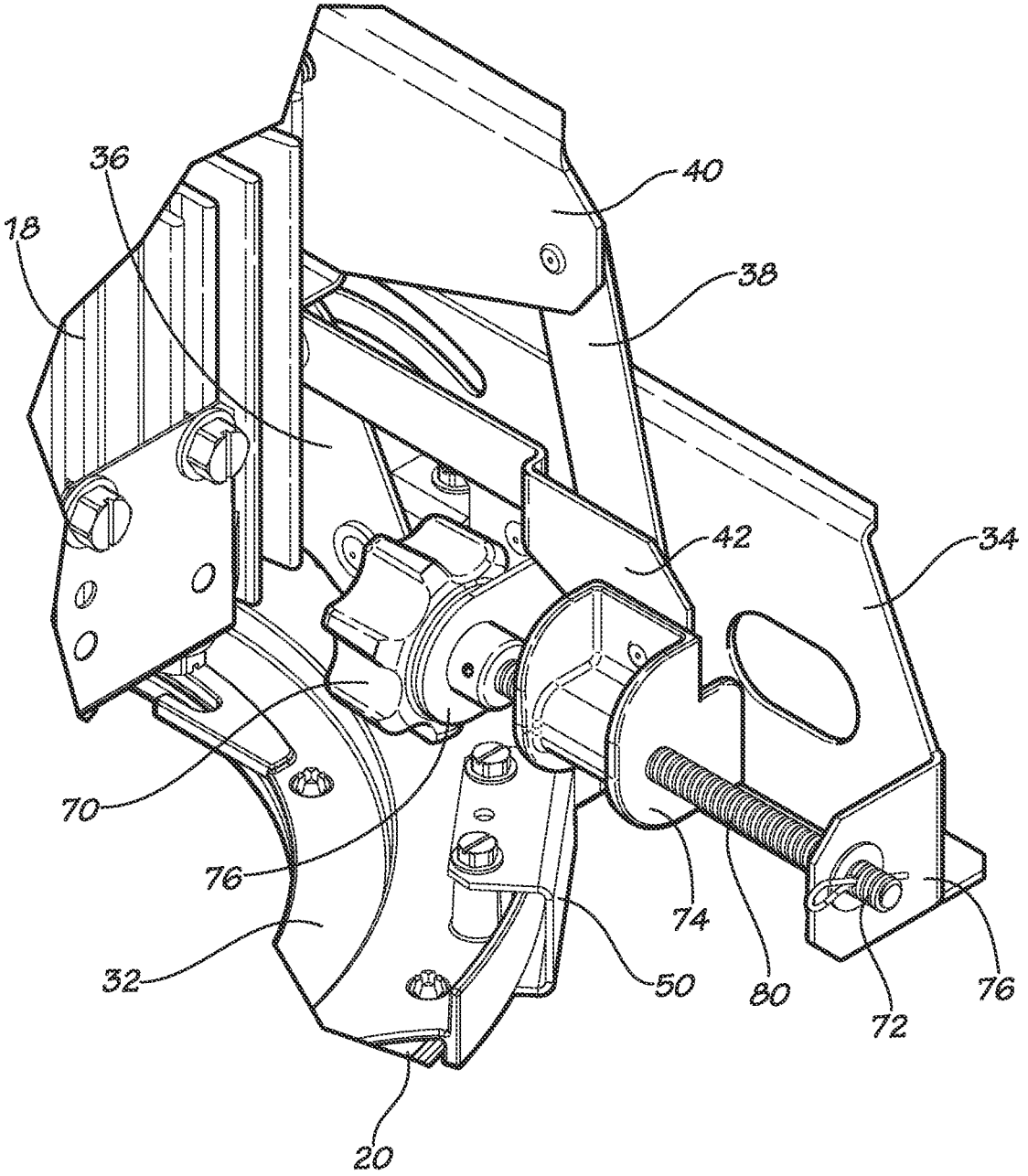
FIG. 11 is an enlarged partial view of a portion of the light assembly of FIG. 1.
Figure 12A:
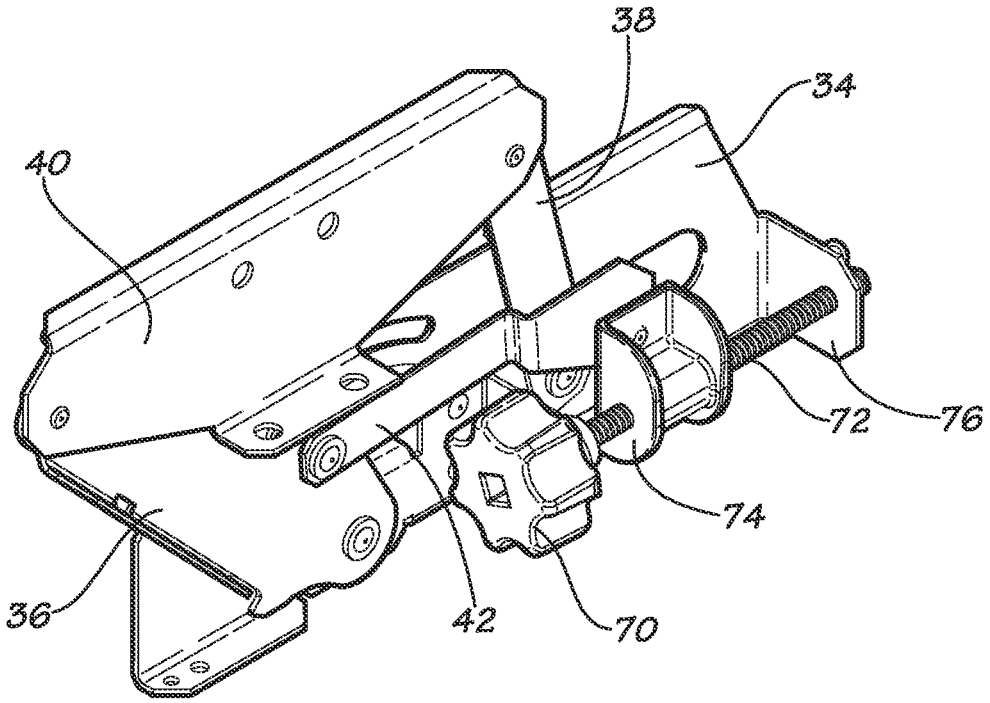
FIGS. 12*a* and 12*b* show views of the tilt mechanism of the light assembly in a level state.
Figure 12B:
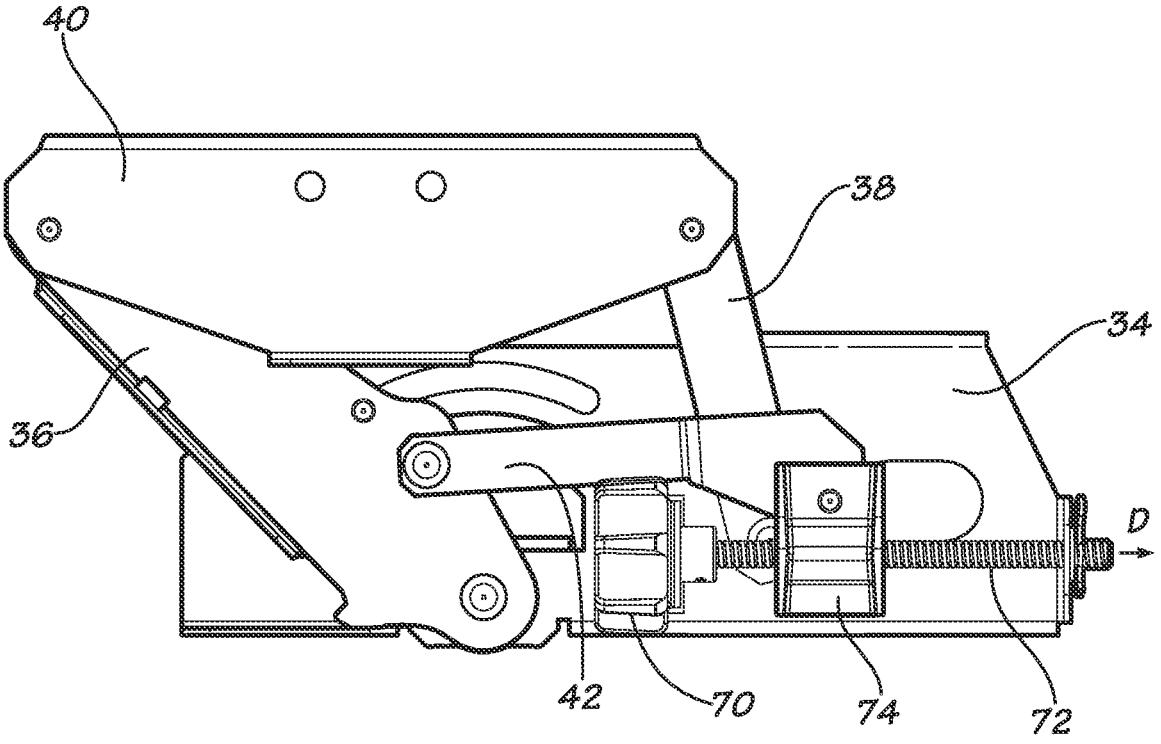
Figure 13A:
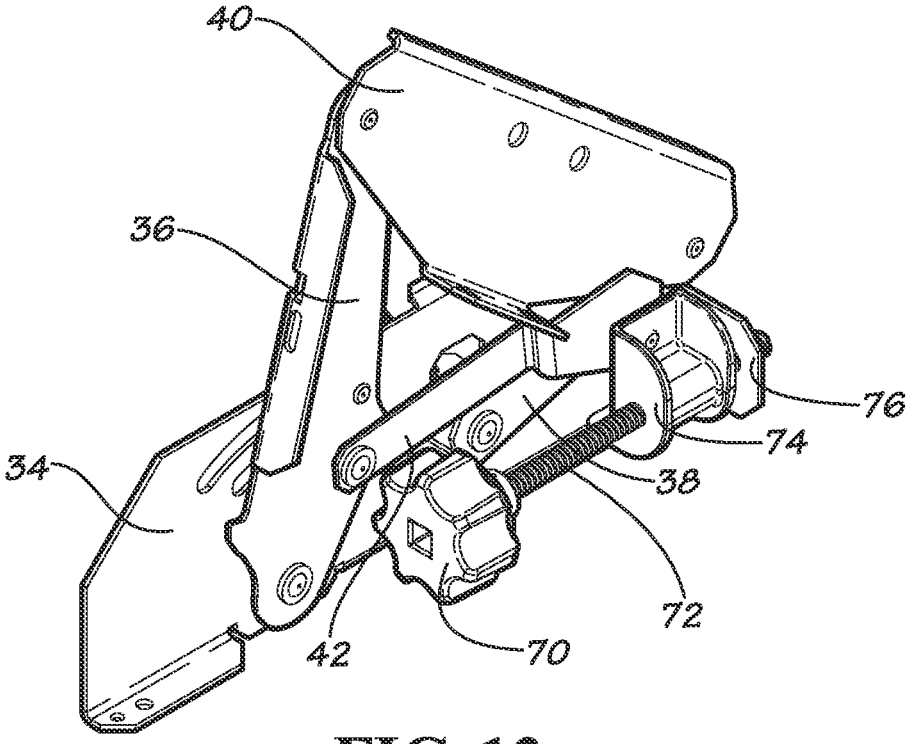
FIGS. 13*a* and 13*b* show views of the tilt mechanism of the light assembly in a tilted state.
Figure 13B:
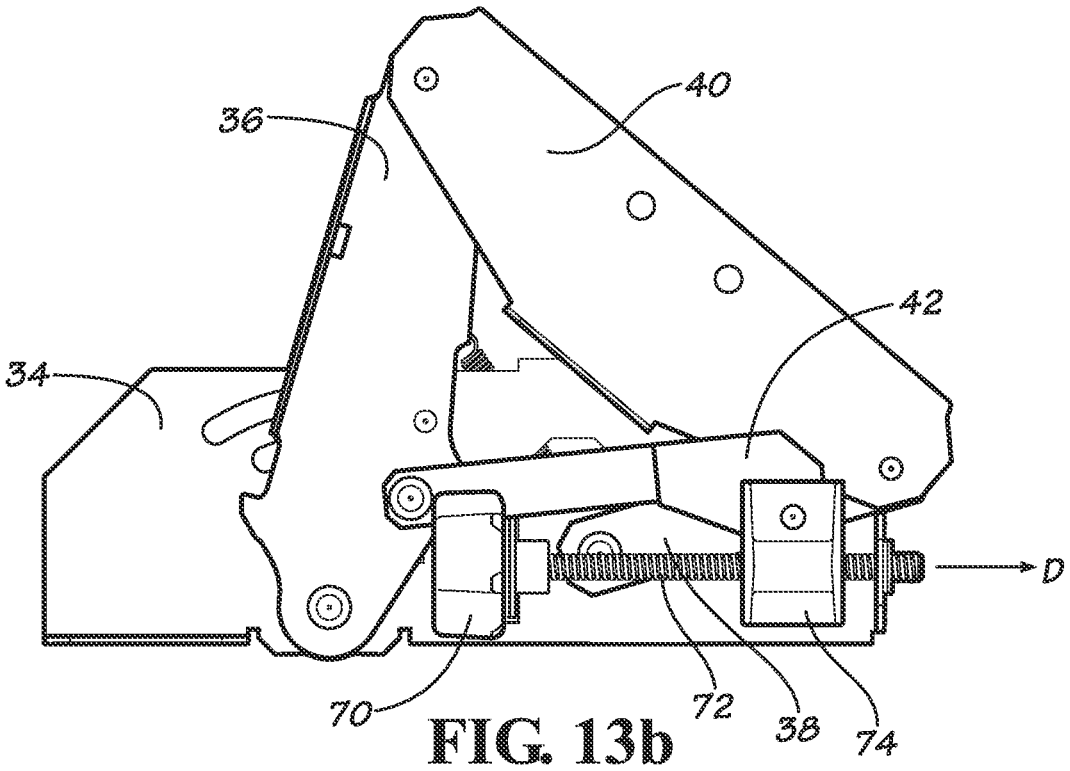
Figure 14A:
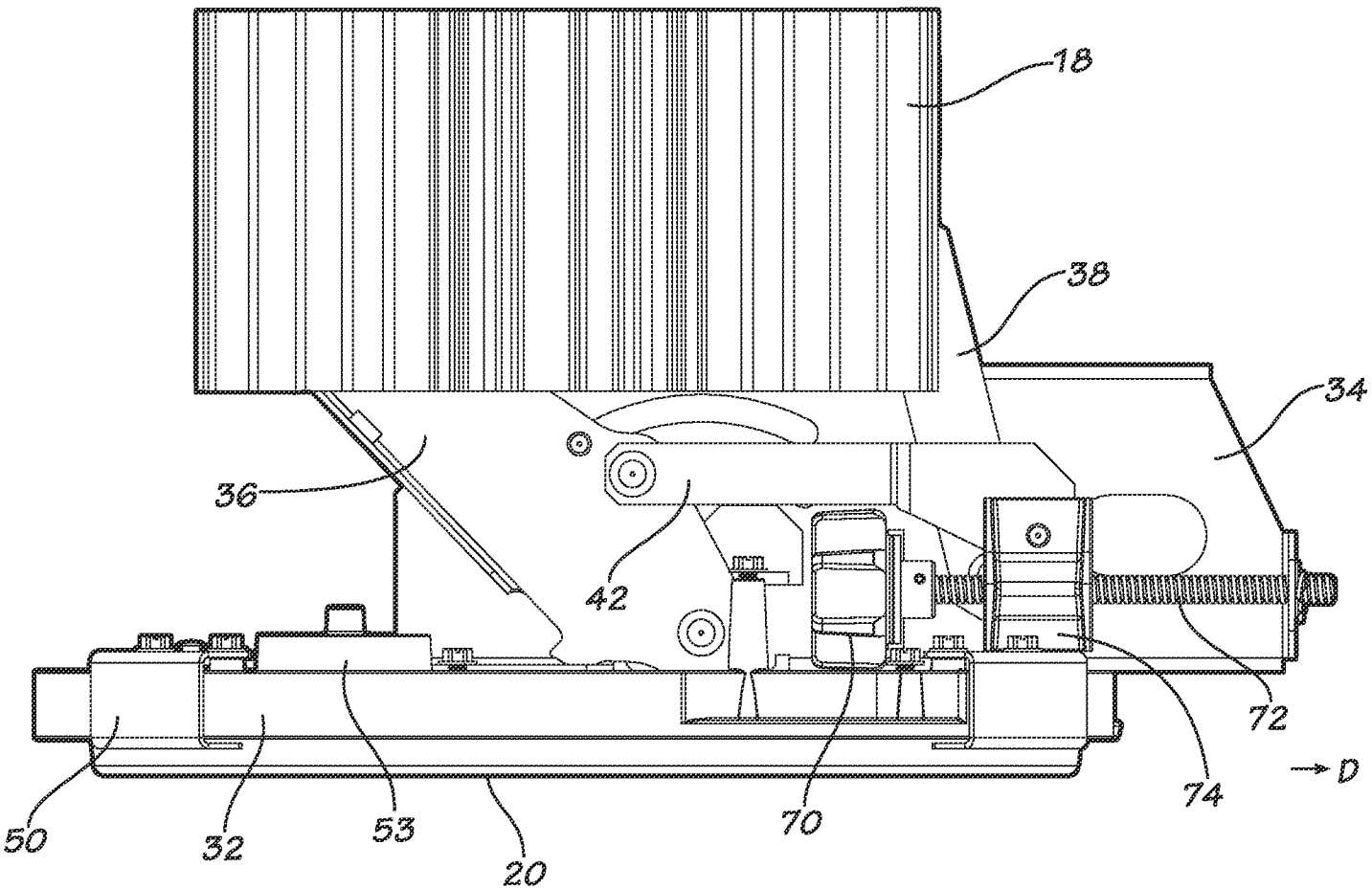
FIGS. 14*a*-14*e* show a tilt progression of an embodiment of a light engine of the light assembly.
Figure 14B:
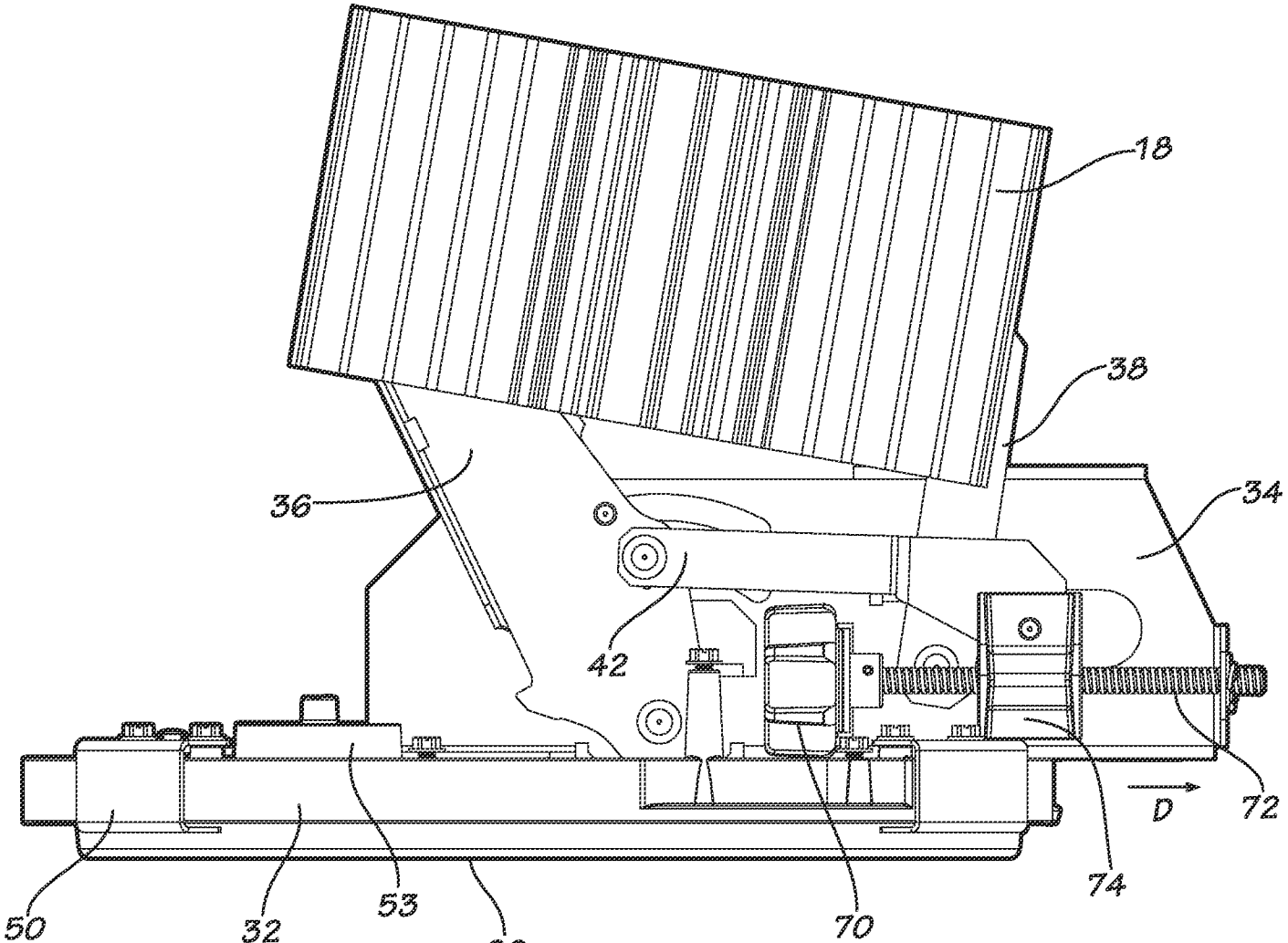
Figure 14C:
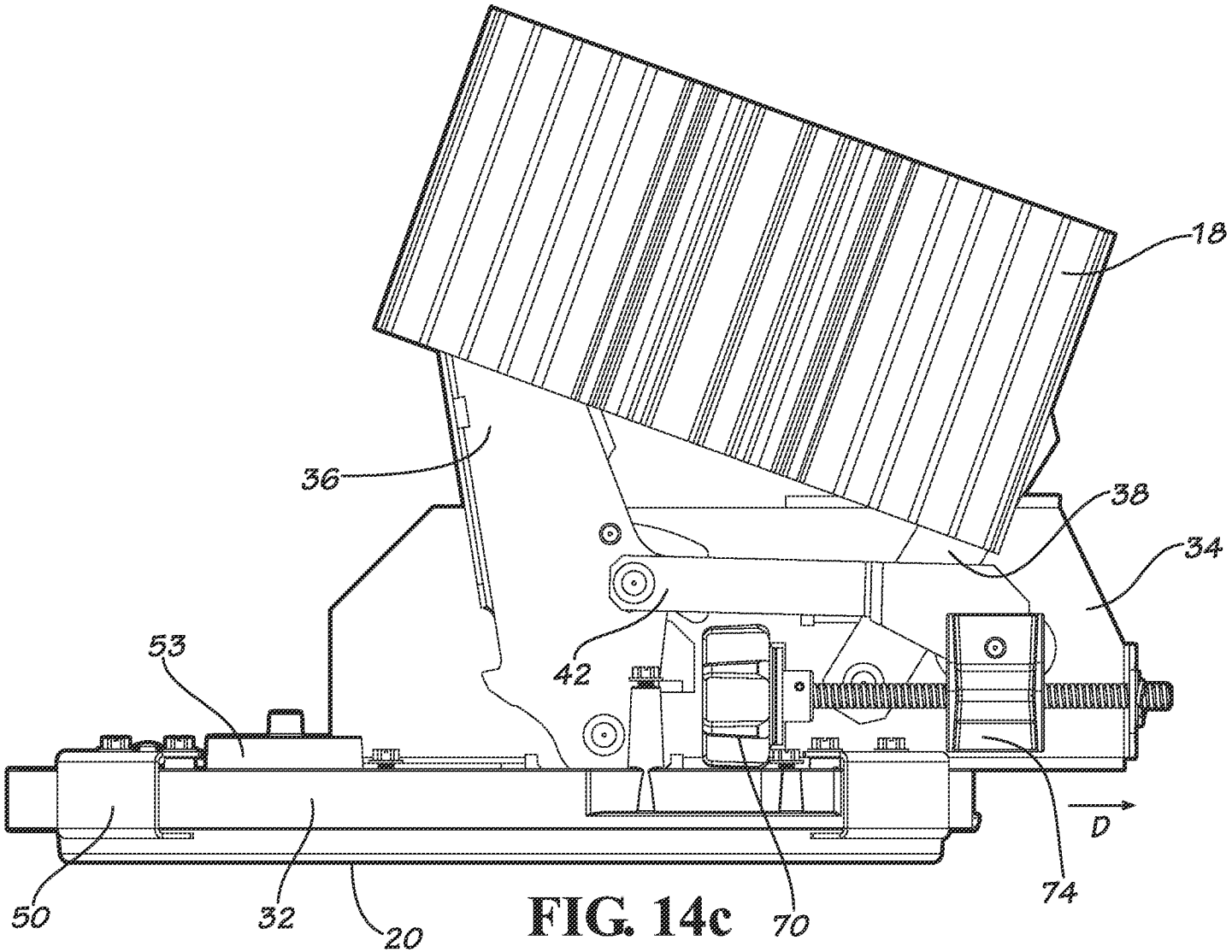
Figure 14D:
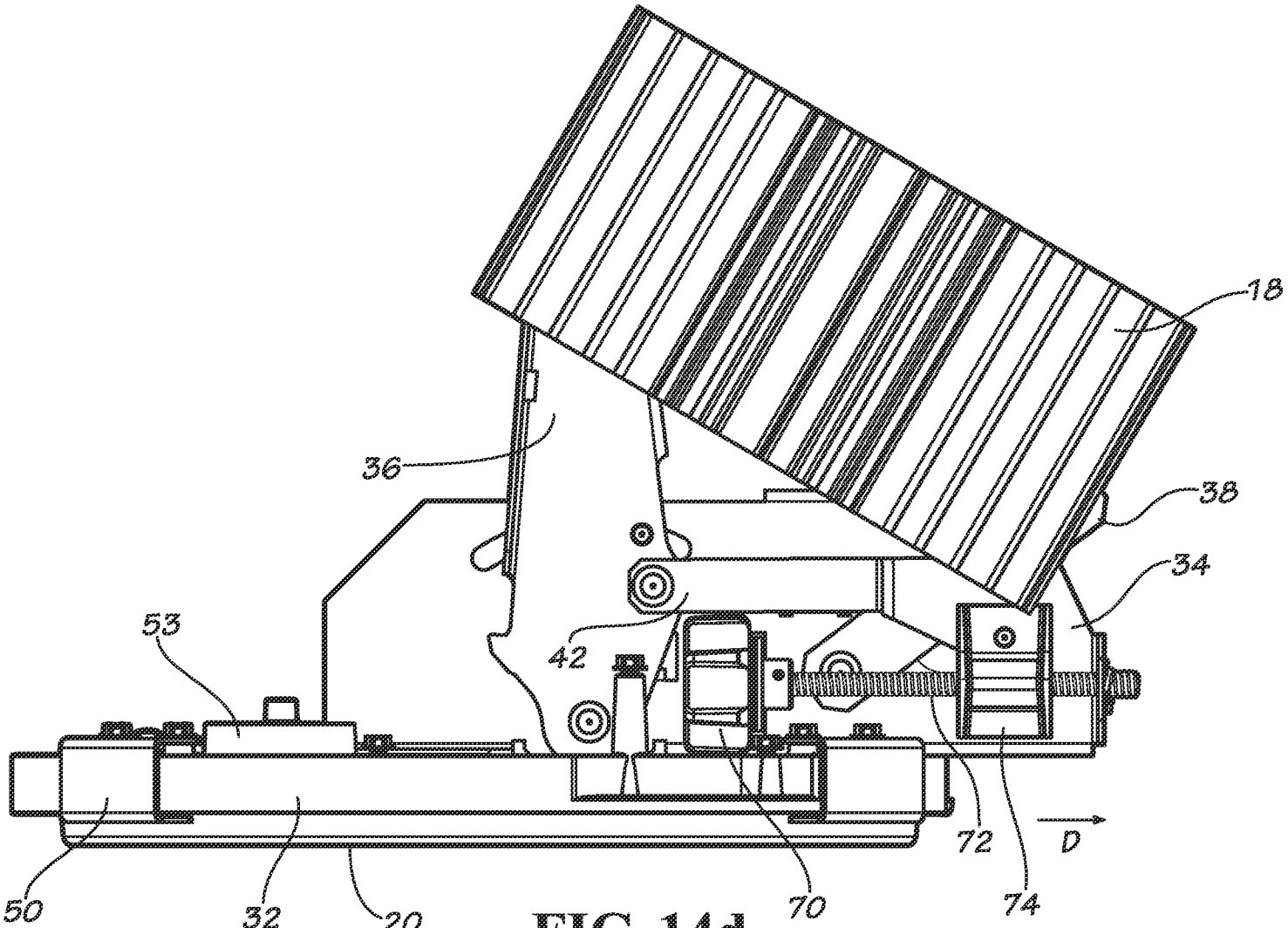
Figure 14E:
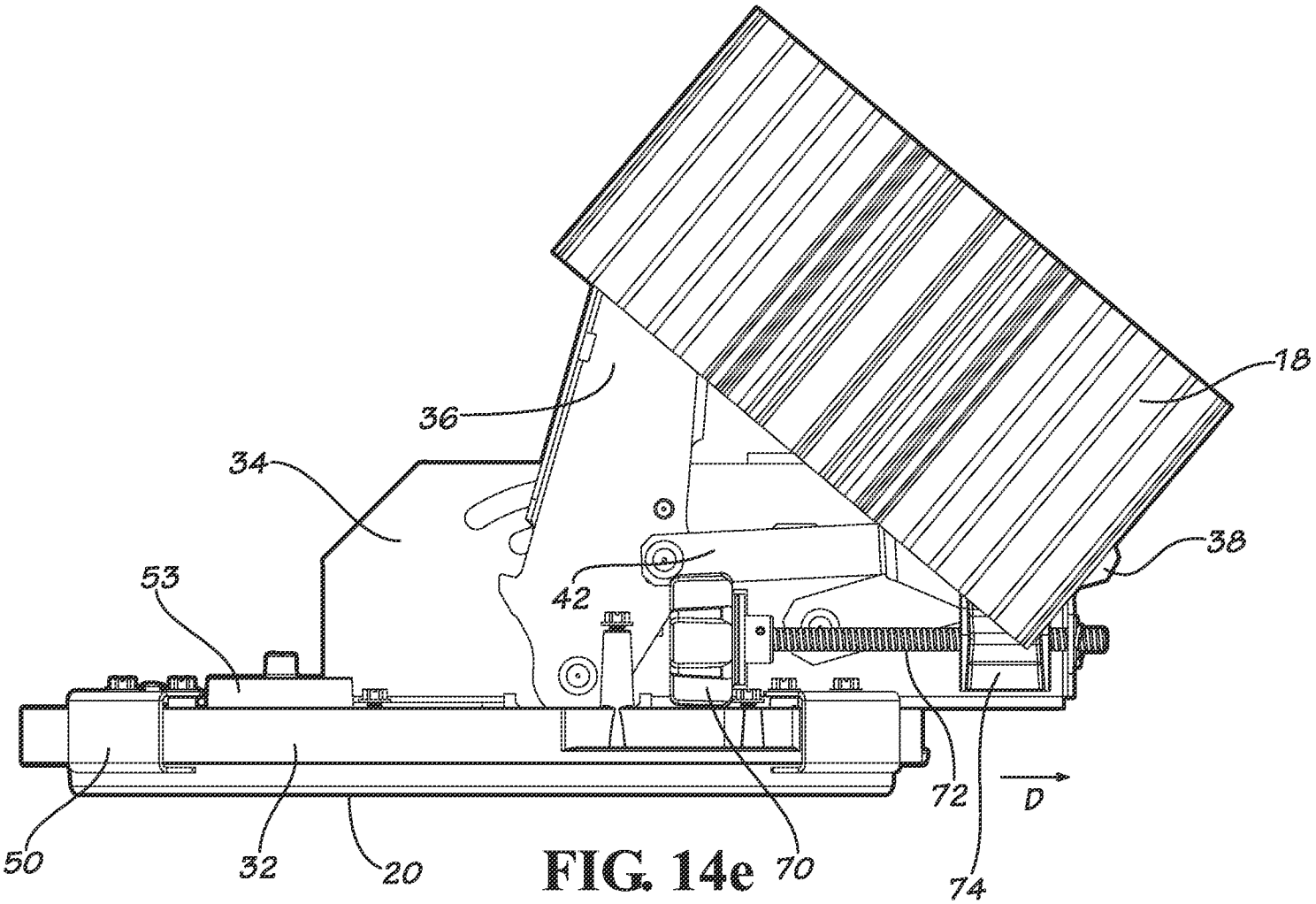

Embodiments of the light assembly 10 (one embodiment of which is shown assembled in FIG. 1) include a pan or mounting frame 12 on which a light engine 14 is mounted so as to direct light through the mounting frame opening 16 and out of an opening in the ceiling. The light assembly 10 is designed to permit the light engine 14 to be rotated and tilted without the need for tools. Thus, while tools certainly may be used, they need not be.

The illustrated light engine 14 generally includes a heat sink 18 and a light source (such as, but not limited to, light emitting diodes mounted on a printed circuit board, not shown) mounted to the heat sink 18. However, any light engine having any light source(s) may be used and embodiments of the invention are certainly not intended to be limited to the light engine 14 illustrated in the attached figures. By way only of example, the light engine could include the embodiments disclosed in U.S. patent application Ser. No. 13/828,543, filed Mar. 14, 2013 and entitled "Light Engine," the entirety of which is herein incorporated by reference.

A mounting ring 20 is mounted on the mounting frame 12 at least partially about the mounting frame opening 16 and includes a plurality of gear teeth 22 that extend at least partially (and in some embodiments, entirely) around the mounting ring 20. The mounting ring 20 may be fixedly mounted onto the mounting frame 12 such as with screws or other mechanical fasteners 21. Indeed, in some embodiments the mounting ring 20 is integrally-formed with the mounting frame 12. However, it may be useful in some embodiments to provide for rotational movement of the mounting ring 20 relative to the mounting frame 12 after the mounting ring 20 has been mounted on the mounting frame 12. In one embodiment, the mounting ring 20 includes at least one elongated mounting slot 24 through which a mechanical fastener 21 (such as a screw) may pass to mount the mounting ring 20 to the mounting frame 12. As discussed below, the mounting slot(s) 24 permit the mounting ring 20 to rotate relative to the mounting frame 12 after the mounting ring 20 has been mounted on the mounting frame 12. The degree of such permitted rotation will obviously depend on the geometry of the mounting slot(s) 24.

The light engine 14 is supported by a support frame 30 that includes a rotation ring 32 and two opposing upraised mounting brackets 34 mounted on the rotation ring 32. In one embodiment of the support frame 30, a front lifting arm 36 and a rear lifting arm 38 are pivotably connected to each mounting bracket 34 on a first end and to a light engine support bracket 40 on an opposing, second end. A first end of a lifting bracket 42 is pivotably connected to one of the front lifting arms 36. The light engine 14 is secured to the light engine support brackets 40 (such as with fasteners such as screws 41) to thereby support the light engine 14 within the ceiling.

Rotation

The rotation ring 32 of the support frame 30 seats over the mounting ring 20. The rotation ring 32 may be secured to the mounting ring 20 to prevent their separation. By way only of example, one or more securing brackets 50 may extend or wrap around the edges of the mounting ring 20 and the rotation ring 32 to secure together, but still permit relative rotation between, the rotation ring 32 and the mounting ring 20. A rotation knob 52 (shown housed in a cover 53 on the rotation ring 32) is provided on the rotation ring 32 and includes gear teeth 54 that engage the gear teeth 22 provided on the mounting ring 20. To adjust the rotational orientation of the light engine 14 relative to the mounting frame 12, one need only reach up through the mounting frame opening 16 and rotate the support frame 30 with associated light engine 14. In this way, the entire support frame 30 (with associated light engine 14) rotates relative to the mounting ring 20 to orient the light engine 14 in the generally desired rotational orientation. Once the light engine 14 is generally in position, the rotation knob 52 can be rotated to effectuate rotation of the rotation ring 32 relative to the mounting ring 20 to fine tune the rotational orientation of the support frame 30 and thus the associated lighting engine 14. One of skill in the art will understand that the rotation knob 52 need not only be used for minor rotational adjustments of the support frame 30/light engine 14 but rather may be used solely to effectuate the desired rotation.

A stop (or stops) may be provided to limit the extent to which the rotation ring 32 (and thus the support frame 30/light engine 14) may rotate relative to the mounting ring 20. For example, a rotational stop tab 60 may be provided and extend both upwardly from the mounting ring 20 and downwardly from the rotation ring 32. Abutment of the rotational stop tabs 60 limits rotation of the rotation ring 32 relative to the mounting ring 20 beyond a specified degree (which in some cases may be 360°). However, the elongated mounting slot(s) 24 by which the mounting ring 20 is attached to the mounting frame 12 (if used) permit rotation of the mounting ring 12 about the mounting frame opening 16 and therefore permit additional rotation of the rotation ring 32 about the mounting frame opening 16 to a degree dictated by the geometry of the mounting slot(s) 24.

Tilting

Tilting may be accomplished with a tilt knob 70 with associated rod 72 and a slide 74 mounted on the rod 72. Wings 76 extend from one of the mounting brackets 34 and each wing 76 includes an aperture through which the rod 72 and/or tilt knob 70 partially extends such that the wings 76 support the tilt mechanism. Threads 80 on the rod 72 engage threads within the slide 74 (not shown) such that rotation of the tilt knob 70 causes longitudinal movement of the slide 74 along the rod 72. The slide 74 mounted on the rod 72 is connected to a second end of the lifting bracket 42, which, as explained above, has a first end pivotably attached to one of the front lifting arms 36. To tilt the light engine 14, the tilt knob 70 is rotated, causing the slide 74 to move along the rod 72 in a direction D away from the tilt knob 70. While the tilt knob 70 may be rotated by hand, in other embodiments receptacles may be provided on the head of the knob to receive tools (e.g., drills, screwdrivers, etc.) to rotate the tilt knob 70.

Because the slide 74 is connected to the lifting bracket 42, which in turn is connected to a front lifting arm 36, movement of the slide 74 causes the lifting bracket 42 to rotate and pull the front lifting arm 36 up and back toward the slide 74. This movement of the front lifting arm 36 effectuates (1) tilting of the light engine 14 as well as (2) lateral displacement of the light engine 14 in direction D, as seen in the tilt progression shown in FIGS. 14*a*-14*e*. If the light engine 14 simply tilted, part of its emitted light would be cut off (i.e., would not make it through the mounting frame opening 16 and out of the ceiling). However, lateral movement of the light engine 14 backwardly ensures that the entirety of its emitted light is directed through the opening 16 when the light engine 14 is in a tilted position. In some embodiments the light engine 14 can be quite heavy. Thus, any number of springs 90 may be provided on the assembly 10 to counterbalance the weight of the light engine 14 during tilting. However, the inclusion of springs 90 is optional and not required.

The foregoing is provided for purposes of illustrating, explaining, and describing embodiments of the present invention. Further modifications and adaptations to these embodiments will be apparent to those skilled in the art and may be made without departing from the scope or spirit of the invention. Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the invention.

I claim:

1. A light assembly comprising:

a. a mounting frame having an opening defined within the mounting frame, wherein the opening has an opening axis;

b. a mounting ring comprising a plurality of teeth, wherein the mounting ring is positioned to extend at least partially around the mounting frame opening;

c. a light engine suspended over the mounting frame so as to emit light through the mounting frame opening; and d. a support frame located on the mounting frame for supporting the light engine, wherein the support frame comprises:

i. a rotation ring seated over the mounting ring and comprising a rotation knob accessible via the opening when the light assembly is installed, wherein the rotation knob comprises teeth that engage at least some of the plurality of teeth on the mounting ring;

ii. a first mounting bracket extending upwardly from a first side of the mounting frame opening and a second mounting bracket extending upwardly from a second side of the mounting frame opening opposite the first side;

iii. a first light engine support bracket and a second light engine support bracket, wherein the light engine is attached to the first and second light engine support brackets;

iv. a first front lifting arm pivotably connected directly to and extending between the first mounting bracket and the first light engine support bracket and a first rear lifting arm pivotably connected directly to and extending between the first mounting bracket and the first light engine support bracket such that the first light engine support bracket is attached and movable relative to the first mounting bracket;

v. a second front lifting arm pivotably connected directly to and extending between the second mounting bracket and the second light engine support bracket and a second rear lifting arm pivotably connected directly to and extending between the second mounting bracket and the second light engine support bracket such that the second light engine support bracket is attached and movable relative to the second mounting bracket;

vi. a tilt knob accessible via the opening when the light assembly is installed and supported on the first mounting bracket;

vii. a rod extending from the tilt knob along an axis oriented at an angle to the opening axis, wherein the rod comprises threads; and viii. a slide mounted on the rod and comprising threads that engage the threads on the rod, wherein the light engine is rotatable relative to the mounting frame by hand rotation of the rotation knob so as to rotate the rotation ring relative to the mounting ring and wherein the light engine is tiltable relative to the mounting frame by hand rotation of the tilt knob to move the slide along the rod in a direction oriented at the angle to the opening axis.

2. The light assembly of claim 1, wherein the mounting ring comprises at least one elongated slot and is secured on the mounting frame by at least one fastener extending through the at least one elongated slot, wherein, when so secured, the mounting ring may rotate relative to the mounting frame by movement of the at least one fastener within the at least one elongated slot.

3. The light assembly of claim 1, further comprising at least one securing bracket to secure the mounting ring and rotating ring together.

4. The light assembly of claim 1, wherein the mounting ring comprises a stop tab and wherein the rotation ring comprises a stop tab and wherein abutment of the mounting ring stop tab and the rotation ring stop tab prevents rotation of the rotation ring relative to the mounting ring beyond a specified degree.

5. The light assembly of claim 1, wherein the support frame further comprises a lifting bracket connected to the first front lifting arm and to the slide, wherein rotation of the tilt knob causes longitudinal movement of the slide along the rod in the direction and rotation of the first front lifting arm upwardly toward the slide to tilt the light engine upwardly.

6. The light assembly of claim 5, wherein rotation of the tilt knob causes lateral movement of the light engine in the direction.

7. A method of moving a light engine relative to a mounting frame comprising:

a. providing a mounting frame having an opening defined within the mounting frame, wherein the opening has an opening axis;

b. providing a support frame on the mounting frame, wherein the support frame comprises:

i. a first mounting bracket extending upwardly from a first side of the mounting frame opening and a second mounting bracket extending upwardly from a second side of the mounting frame opening opposite the first side;

ii. a first light engine support bracket and a second light engine support bracket;

iii. a first front lifting arm pivotably connected directly to and extending between the first mounting bracket and the first light engine support bracket and a first rear lifting arm pivotably connected directly to and extending between the first mounting bracket and the first light engine support bracket such that the first light engine support bracket is attached and movable relative to the first mounting bracket;

iv. a second front lifting arm pivotably connected directly to and extending between the second mounting bracket and the second light engine support bracket and a second rear lifting arm pivotably connected directly to and extending between the second mounting bracket and the second light engine support bracket such that the second light engine support bracket is attached and movable relative to the second mounting bracket;

v. a tilt knob accessible via the opening when the light assembly is installed and supported on the first mounting bracket;

vi. a rod extending from the tilt knob along an axis oriented at an angle to the opening axis, wherein the rod comprises threads;

vii. a slide mounted on the rod and comprising threads that engage the threads on the rod; and viii. a lifting bracket connected to the first front lifting arm and to the slide;

c. securing the light engine to the first and second light engine support brackets so as to be suspended over the mounting frame opening; and d. moving the light engine relative to the mounting frame by rotating the tilt knob by hand so that the slide moves along the rod in a direction oriented at the angle to the opening axis and the first front lifting arm rotates upwardly toward the slide to tilt the light engine relative to the mounting frame.

8. The method of claim 7, wherein rotating the tilt knob laterally moves the light engine in the direction.

9. The method of claim 7, wherein the support frame further comprises a rotation ring comprising a rotation knob having teeth, the method further comprising:

providing a mounting ring comprising a plurality of teeth, wherein the mounting ring is positioned to extend at least partially around the mounting frame opening and wherein the rotation ring is seated over the mounting ring so that the teeth on the rotation ring engage at least some of the plurality of teeth on the mounting ring; and rotating the light engine relative to the mounting frame by rotating the rotation knob by hand so as to rotate the rotation ring relative to the mounting ring.

* * * * *